United States Patent [19]

Nightingale et al.

[11] Patent Number: 4,471,687

[45] Date of Patent: Sep. 18, 1984

[54] CUSHION CYLINDERS

[75] Inventors: Richard P. Nightingale, Fox River Grove; Robert P. Vandlik, Mt. Prospect, both of Ill.

[73] Assignee: American Can Company, Greenwich, Conn.

[21] Appl. No.: 322,369

[22] Filed: Nov. 17, 1981

[51] Int. Cl.[3] ..... F01B 7/00

[52] U.S. Cl. ..... 92/62; 92/65; 92/66; 92/85 B; 92/107; 92/117 A; 92/143; 72/347; 267/119

[58] Field of Search ..... 92/8, 10, 51, 52, 61, 92/62, 65, 66, 85 R, 85 B, 107, 117, 117 A, 117 R, 143; 72/347, 348, 349, 350, 351; 267/119

[56] References Cited

U.S. PATENT DOCUMENTS

| | | | |
|---|---|---|---|
| 3,793,871 | 2/1974 | Kinghorn | 72/349 |
| 3,902,718 | 9/1975 | Avon | 92/107 |
| 4,006,666 | 2/1977 | Murray | 92/85 B |
| 4,111,030 | 9/1978 | Shepard et al. | 267/119 |
| 4,365,499 | 12/1982 | Hirota et al. | 72/351 |

*Primary Examiner*—Robert E. Garrett
*Assistant Examiner*—Scott L. Moritz
*Attorney, Agent, or Firm*—Paul R. Audet; Aaron Passman

[57] ABSTRACT

The disclosure describes a new type of pressure cylinder to provide clamping force while fabricating deep drawn metal parts. The piston is a hollow cylinder connected to the clamping pad. The drawing tools are connected to the draw ram by a rod passing through the hollow piston. This arrangement provides a smaller overall press height and an axisymmetric clamping force. In addition, the symmetry of the parts described means that the wear parts can be reversed to double their useful lives.

11 Claims, 12 Drawing Figures

CUSHION CYLINDERS

BACKGROUND OF THE DISCLOSURE

This disclosure relates to a large press for forming thin walled hollow drawn containers from precoated stock by a series of multiple forming operations in the press. More particularly, a press is disclosed which can put out about 700 containers per minute. The containers being formed by the operations of blanking and cupping, drawing, redrawing-profiling and trimming. In the past there has been a unitary press for producing such hollow drawn containers at rates of about 125 per minute. This press is disclosed in, for example, U.S. Pat. No. 4,262,510. Such a press was limited in terms of capacity by the nature of its mechanical design for handling the containers and the material entering and leaving the press. In addition, there have been arrangements for producing such containers in a more efficient manner by using multiple presses with transfer conveyors between them. Those arrangements require synchronization between the multiple presses and take more space and money to construct and operate. Consequently, the need for at least two presses in such a system subjects one press to the infirmities of its companion. That is to say that, if one or the other is down both are down. Similarly, difficulty with the conveyor will stop production.

The container made by the press disclosed herein is best disclosed in connection with U.S. Ser. No. 234,452 CONTAINER, wherein a detailed description of the type of container and its construction and use are provided. Such containers must be made on high speed equipment as their cost must be minimized for each is a disposable single use item. Similarly, such containers are usually made of precoated stock as disclosed, for instance, in U.S. Ser. No. 230,610, DRAWABLE COATING. It, therefore, becomes important to make and handle the containers at high speeds but with sufficient care to prevent damage to the thin wall or fragile precoating during the multiple forming operations.

In the past, techniques have been suggested for moving partially formed containers through the tooling in a press for progressive forming, see, for example, U.S. Pat. No. 4,373,370 PRESS TRANSFER BAR or more germaine to this particular disclosure, U.S. Pat. No. Re. 29,645 which discloses a transfer arrangement which does not provide positive displacement or handling of the containers during transfer from one operating station to the next. U.S. Pat. No. 1,935,854 discloses an intermittent transfer operation akin to that of the present disclosure but not as uniform or continuous. Here the mechanism for transferring the partially formed drawn and redrawn containers have been streamlined so that a gang of such transfer mechanisms can be included within the press opening between the tools.

It is also important that a press capable of manufacturing containers at the speeds required be simple and compact. In a large press a series of refinements in every area of the press construction promote structural integrity and operational efficiency. More particularly, it is essential that the operations which require large tools and large space be done on one side of the press crown and those operations that can be closer together be done on another side of the press crown such that the overall size of the press in plan is minimized. U.S. Pat. No. 4,026,226 shows an inverted press with forming operations above and below the crown such that distinct operations can be made separately in the same press. In that press, tabs are made atop the crown and ends are made beneath the crown. The tabs are assembled to the ends beneath the crown. That press merely separates the tooling but not for economy of space or construction and also not to minimize the horsepower required to drive the press. More specifically, the peak load requirements are cut by using both the upstroke and downstroke of the press and, in addition, the load on the driving members is balanced better.

In order to be able to do multiple operations at different levels in the same press handling of the containers becomes critical. Handling techniques, equipment and processes have been disclosed in connection with the aforementioned inverted presses. More particularly, in the end press the tab is carried by the parent metal from which it is formed to the opposite side of the crown for assembly to the end. In the prior inverted container press, the partially formed cans are transferred by oscillating fingers carried by shifting transfer bars. With those arrangements piece part movement during progressive forming is accurate but the mechanisms are large and complicated. A simple mechanism for multilane transfer in a large progressive press has not been seen in the prior art.

To minimize the overall size of such large presses for multiple forming containers at high speeds, it is necessary to drive more than one portion of the tooling off of one portion of the crank shaft using a common drive element thus minimizing the number of connecting rods, drive arms and the like. To some extent this feature has been disclosed in the aforementioned inverted end press, however, in a large press with multiple forming stations above and below the crown this feature has been significantly refined. Furthermore, the clamping and forming rams have been nested aside one another rather than being stacked atop of one another, or as in the past, nested by placing one ram in the hollow confines of another and gibbing the first to the second such that the tolerances of the nested ram and those of the carrying ram in which it is nested are cumulative. Here the gibbing systems are independent of one another such that tolerance problems are minimized. In addition, gibbing systems have usually had external or open lubrication subject to environmental conditions and dirt thus causing a certain amount of mess in the press where the products are made as well as in the surrounding environment of the plant. This open lubrication of the gibbing causes problems of cleanliness, loss of lubricant and requires particular care in making good sanitary food containers. Similarly, the use of cushion cylinders which get within the same and about the tooling in order to maintain a minimum overall height is unique. In the crank case for the press there is a worm and gear drive. The roller bearings for the worm are set in the sides of the crank case such that lubricant for the bearings is pumped into them from above and removed from below. This arrangement to be effective must control the flow of oil through the bearings to prevent churning which would cause oil degradation and overheating. Vertical press size limitations, crankcase wall strength and requisite support for the bearing prevent the use of sufficiently large passages to provide adequate flow for draining these bearings.

Every press frame is constructed from a series of individual components. The components are usually fashioned in accordance with the facilities available for manufacturing the press frame parts and in accordance with the need to maintain tolerances as required for the accuracy necessary to make the press assembly and operate efficiently and reliably. Nowhere is there disclosed a press that is composed of multiple subassemblies which are individually operative units for run-in or testing purposes, but which interconnect to permit the various subassemblies to cooperate with each other. Furthermore, the opportunity to individually check such subassemblies of a large press prior to assembly of the whole or during repair of one portion are not disclosed in any of the art.

OBJECTS OF THE DISCLOSURE

An object of this disclosure is to prevent a compact press capable of multiply forming containers from precoated stock at a rate of about 700 per minute.

Another object of the disclosure is to provide a simplified can conveying systems for multiple use in such a press.

Yet another object is to provide design features which facilitate the manufacturing, testing, repair and assembly of such a press.

A still further object is to provide a transfer mechanism which is compact but can handle a series of lanes of cans progressing through multiple forming operations.

Yet another object is to provide a compacted nested ram construction which is designed to maintain minimum tolerances for controlled ram movement.

An additional object is to provide a cushion cylinder arrangement which is conveniently used in connection with such a press and which compactly supports the tooling.

A further object is to provide an improved gibbing system which is clean, compact, reliable and easy to fabricate and simple to assemble.

Another object is to provide a technique and an arrangement of components which will insure adequate lubricant flow through high speed roller bearings.

SUMMARY OF THE DISCLOSURE

In accordance with the foregoing objects and in order to solve the problems of the prior art, a multiple operation inverted style press is disclosed with its crank shaft below the feed line for driving both the ram in a lower cupping press and a double action redraw press mounted above it. The cupping press processes a scrolled sheet into cups which are conveyed to the upper press where multiple drawing, redrawing-profiling and trimming operations progressively take place. Specifically, the upper press has two redraw stations (the second with profiling) and one trimming station. Both the cupping and the upper presses have two ram strokes, one for the shearing and/or clamping and one for the drawing or redrawing or trimming. The cupping draw ram has a 9" stroke and is driven directly by the crank shaft through a pair of connecting rods. The blank and clamp rams in the lower press have about a 5/16" stroke which is driven off the cupping ram by a cam and toggle arrangement. The redraw or upper press has three rams, the two for clamping and trimming have the same 9" stroke as the cupping ram and the ram for the redrawing processes has a 12" stroke. The clamping rams for the upper press are driven through vertical tie rods which are mounted for movement with the cupping ram in the lower cupping press. The draw ram in the redraw press is independently driven by the crank shaft.

In this inverted press, maximum use of the press is made by cupping and blanking below the crown and drawing and redrawing above the crown. More particularly, the first operation (blanking and cupping the scroll stock) is performed below the press crown. The formed cup is made face down (inverted with its open end downward) and then conveyed above the crown to the upper press whereat it is progressively formed by drawing, redrawing and bottom profiling and finally die trimmed about the flange. An advantage of this approach is that the largest diameter, being the blank, is cut in a different part of the press and, therefore, the centerline spacing of the subsequent forming stations can be closer together thus permitting a smaller overall press. Another advantage is that the blanking and cupping is accomplished on one stroke of the inverted press and the other forming operations are performed on the other or opposite stroke. More specifically, moving the cup from below the crown to above is done by a magnetic conveyor system which reverses the cup position so that same is open upwardly for the subsequent forming operations.

As explained, the blanking and cupping are first done in the lower section of the press and a magnetic conveyor system then carries the formed cups to the upper section of the press where first redraw second redraw-profile and trimming progressively takes place. In the lower section of the press the cut edge of the blank establishes the center-to-center distance between the blanking and cupping tooling for each lane. That center distance spacing is a function of the size of the largest container to be made in the press and, therefore, is variable in accordance with the size of the container being made and maximum coil width and minimum scrap. In the upper section of the press the spacing between the adjacent draw and redraw tooling is not restricted to the large diameter of the blank cut edge and the lanes can, for example, be advantageously positioned close to the support posts of the upper section thereby obtaining maximum rigidity. The magnetic conveyor system includes lane dividers for variable spacing the cups to align same with the fixed spacing for the first redrawing and the second redrawing-profiling and trimming tooling. More particularly, the ability to adjust the conveyor for handling containers or different sizes with different tooling having different center distance spacings in the upper and lower sections of the press frame is a part of this disclosure. Similarly, the magnetic conveyor system including upper and lower magnetic belts and a section of transversely positioned rollers which permit not only the transfer of the container from the lower press to the upper press but also allow the requisite shifting of the containers to account for the difference in spacing is an important feature.

A cascade jam feeding technique is used to transfer the partially formed containers received from the magnetic conveyor system to the first redraw station and then to the next redraw-profile station. That technique consists of magnetic feed belts which are positioned to carry the containers tipped slightly away from and relative to the vertical or axis of the tooling whereby each can will only assume the vertical position when fed into axial alignment with the punch and die. Consequently, only the container under the punch is effected by the stroke of the ram. The adjacent containers in line to be fed are not crushed or touched by the punch which pushes the container through the die redrawing it into a smaller diameter container with more height. The redrawn container is then caught by a second magnetic drive belt positioned below the die and is carried to the next or second redrawing punch in the same manner. The second redraw-profile station first redraws the container downwardly but not all the way through the die and then profiles the bottom by pushing the container bottom upwardly against the punch. The formed redrawn-profiled container is released as the punch withdraws and since the container has an untrimmed flange, it is grabbed by a vaccum finger and shifted into position for trimming. The flange trimming operation permits the container to pass all the way through the trimming die. The trim scrap remains on top of the die as the container is caught beneath by a magnetic conveyor belt positioned to carry it from the press. The vacuum finger is cammed upward in its travel toward the next container to avoid the trim scrap as same rests atop the trim die. An advantage of this system resides in the fact that high speed container transfer can be obtained. Moreover, in a press the size of this large inverted press which can handle up to six lanes, this mechanism is simple, modular and efficient such that multiple lanes of containers can be formed alongside one another and a common system can be used for removal of the trim scrap.

The overall structural design of the press in such that the press may be split into three self-contained sections. More particularly, each section can be separately assembled and tested on the floor of the plant and then shipped to the manufacturing site where the components can be put together for operation notwithstanding the common drive for upper and lower rams. The bottom subassembly is the main drive which includes the motor and gear reduction, inching drive, flywheel clutch and brake and crank shaft with pitman arms. The structure is box shaped and opens upwardly forming a strong support for the crank shaft bearings and a collector for the lubricating oil. The crankcase includes flow passages to and from the area for supporting the worm gear roller bearings. These flow passages are connected to input and output pumps whereby the incoming oil flow is adequate to cool and lubricate the roller bearings and the output flow is controlled by a suction pump capable of running dry. That is to say that, the suction pump is used to positively evacuate the bearings such that oil does not accumulate, churn and overheat the bearings.

The center unit includes support posts which tie the upper and lower portions of the press together and when combined with the bottom unit form a complete blanking and cupping press. The cupping punch slide or ram is actuated by pitman arms from the main crank shaft, four cams on the cupping ram actuate the clamp beams through an arrangement of knuckle assemblies which also permit the independent lowering or opening of the die for service and clean out.

The top section is the first and second redraw and trimming area of the press and contains punch and clamp rams, the latter of which are actuated by the rods connected to stroke with the cupping ram. The redraw punch ram is driven by the main crank via tie rod slides driven off the pitman arm which only extends into the cupping unit side frame. Consequently, the three components of the press can be built and tested separately and shipped independently before final assembly because they are integral units. Similarly, the bottom and middle units can be run and tested together.

A technique is used in the upper section of the press to minimize the overall height of the press. There is a requirement for both clamping and redrawing rams. In order to have sufficient vertical section in these rams and to minimize the overall height of the press frame necessary to house the rams a nesting technique is used. More specifically, nesting the redraw ram between a split pair of clamp rams permits adequate vertical height of all the rams but minimizes overall ram height. Normally, the rams would be stacked one atop the other making the vertical height approximately twice as great. By the present technique, the overall height of the press is reduced while each ram can be independently gibbed at both ends to minimize unnecessary ram movement tolerances. The center redraw ram has the longer stroke and is by cantilever supports connected to the punch tooling which coaxially resides within the clamping rams hollow cushion cylinders.

The upper section of the large inverted press has each ram uniquely gibbed. The gibbing system permits all of the return lubricant from the upper part of the support to be carried inside its cylindrical support tubes thus eliminating contamination of the oil or flooding of the tooling during periods of shutdown. Each hollow cylindrical support tube contains all the oil flowing back to the crankcase. More particularly, for each gib support there is a lower support which is located upon the base of the upper section and an upper support which is carried in the crown of the press in a manner which permits the upper support to be floated into axial position thereby allowing the misalignment and eliminating the need for premachining alignment. Cylindrical bushings are carried about the tube and they support the rams by keying the latter to the former. Three of these units are used on each side of the press top section to carry each end of the three rams.

In the clamp rams carried in the upper section of the press there are opening passages for carrying hollow redraw nitrogen cushions which hold the container during the forming by the punch. Conventional systems use a series of cylinders which bias the clamp ram and are connected to a main reservoir. The present disclosure includes self-contained integral cylinders and reservoirs which are carried within the clamp ram, thus minimizing overall press height. The technique also simplifies the overall construction of the press. Each cushion cylinder is associated with a coaxially located tooling punch that rides within the central hollow of the hollow clamp ram cushion. The cushion cylinder is easily serviced and in combination with the ram design includes features which permit quick alignment during changes of tooling for different size containers. More particularly, cylindrical pockets in the rams are provided to accept the cushions for adjustable positioning easing axial alignment of the tooling carried within each hollow cushion.

In operation, the precoated scrolled sheets are automatically and intermittently fed into the lower section of the press. Flangeless cups are formed by blanking and cupping the metal through tooling composed of blanking shears, punches and dies. Any number of lanes up to six lanes of cups are established and are magnetically transferred from the lower section to the upper redraw section. The cups are carried by the transfer conveyor from their open downwardly position through 180° such that they are open upwardly as they arrive at the redraw section. Each lane is fed into the first jam feeding station of the redraw press wherein the cups are in axial alignment with the punches and dies of the first redraw station. As the rams of the redraw section lowers the cups are clamped and drawn through the dies and stripped into position on a magnetic conveyor belt below the die. Each redraw container is taken and jam fed into the second redraw-profile station where a partial redraw is performed and then the bottom is profiled. This time the redrawn container is not pushed entirely through the die, thus, a flange remains. The container is bottom profiled and is carried back up through the die on the punch and stripped above the die. The container is then vacuum transferred to a final operation where the flange is trimmed. This trimming operation allows the trimmed container to pass through the die and be caught by a magnetic conveyor and be removed from the press. The trimmed rings scrap and the sheet stock skelton are independently discharged.

DETAILED DESCRIPTION OF THE DISCLOSURE

Figure 1:
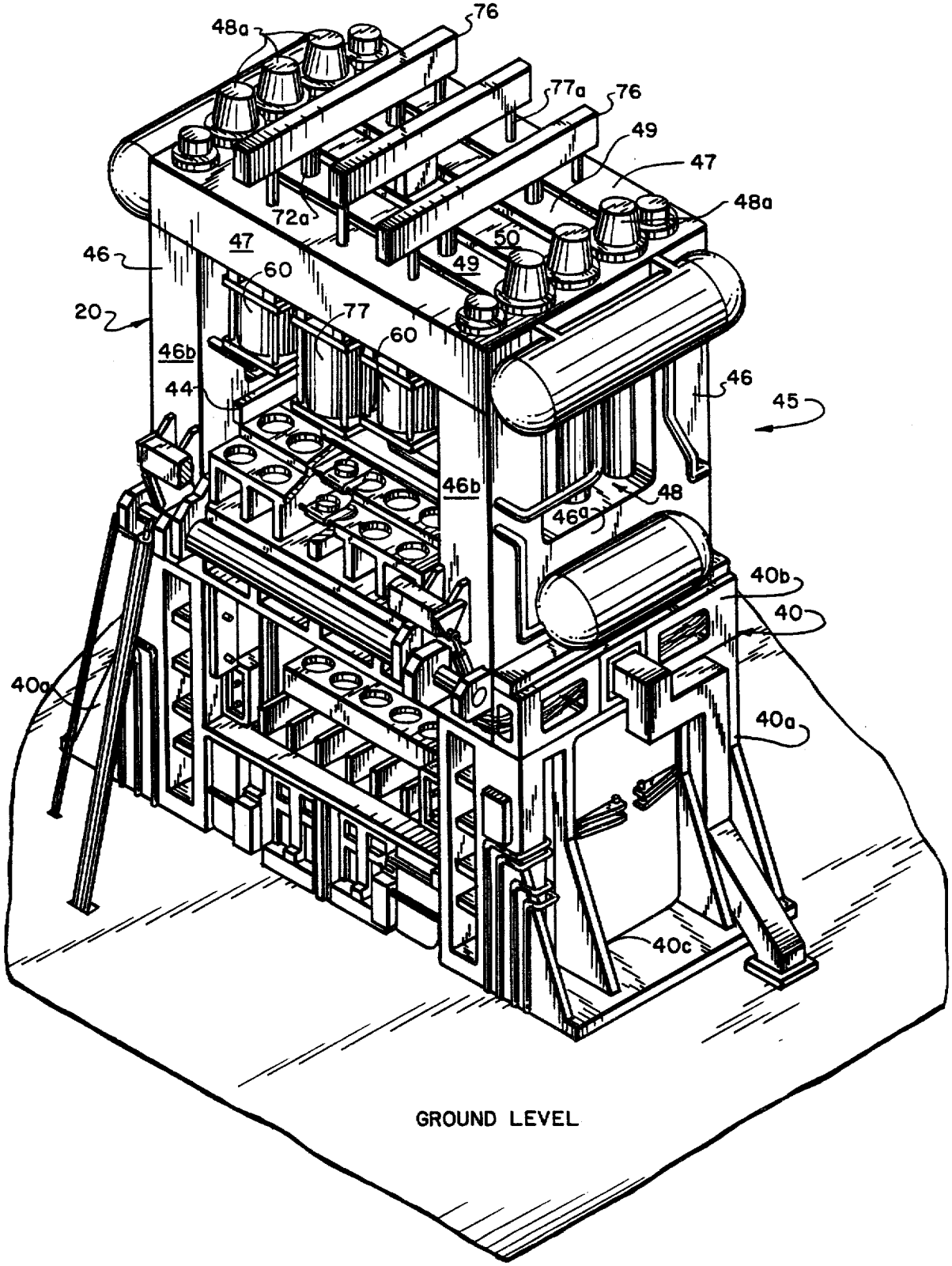
FIG. 1 is a rear perspective view of the upper portion of a large inverted stack press of the present invention.

FIG. 1 is a perspective view above floor level of the press 20 taken from the rear side of the press with portions partially cut away or removed to show the operative lower components relevant to this disclosure. The bottom of the press 20 is best shown in FIGS. 2, 7, 8 and 9 and includes the crankcase and its drive section 30 which supports the crank shaft 31 in end bearings 32 located in the crankcase 33 at each end of the crank shaft. In the center of the crank shaft is a worm driven gear 35 also supported by side bearings 32*a* carried by crankcase 33 and by shaft 36. The worm 34*a* is carried transverse to the crank shaft 31 by a shaft 36 supported by roller bearings carried in the walls of the crankcase 33. In a manner well known a belt drive and motor for same are provided to operate the press 20. The crankcase 33 in the preferred embodiment is located in a pit below ground level and is a hollow box-like construction opened upwardly with a flanged upper face 37 designed to support the press components which are carried by it, FIGS. 8 and 9.

Figure 9:
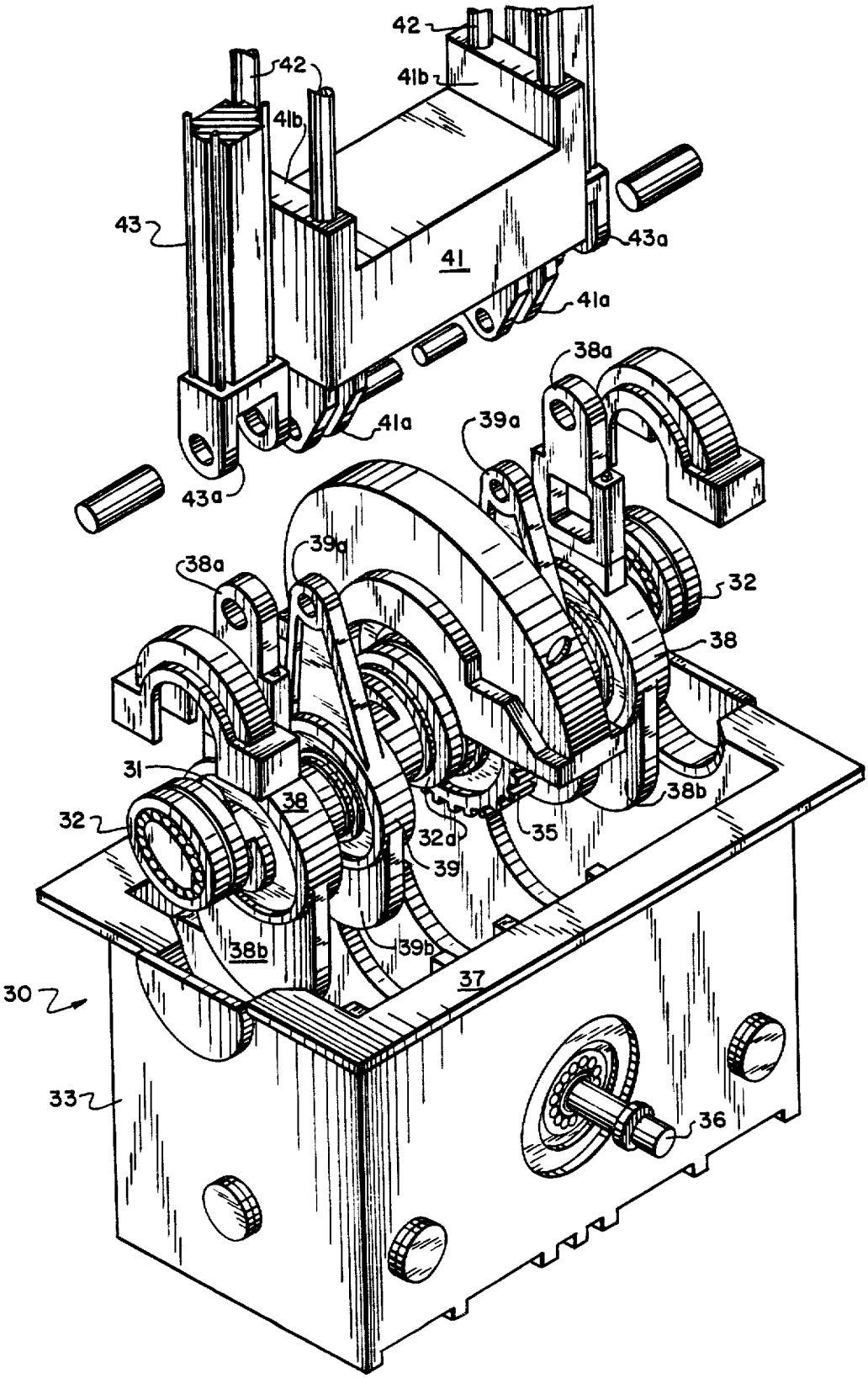
FIG. 9 is a partial perspective view of the portion of the press shown in FIG. 8.

One each side of the crank shaft 31 are eccentrically mounted systems for driving the press rams, FIG. 9. That is to say that, between the crank bearings 32 and the gear 35 there are on each side respective drives for the press clamping and forming rams. More particularly, eccentric redraw drives 38 are carried upon crank shaft 31 just inside crankcase 33 near the crank bearings 32. In the preferred embodiment eccentric redraw drives 38 have a 12" stroke and including a connecting rod 38*a* which is counterweighted at 38*b*. Intermediate eccentric redraw drives 38 and the gear 35 are eccentric cupping and clamping drives 39 having connecting rods 39*a* being counterweighed at 39*b*. Connecting rods 39*a* drive the ram for clamping and cupping as will be explained hereinafter in detail.

Figure 2:
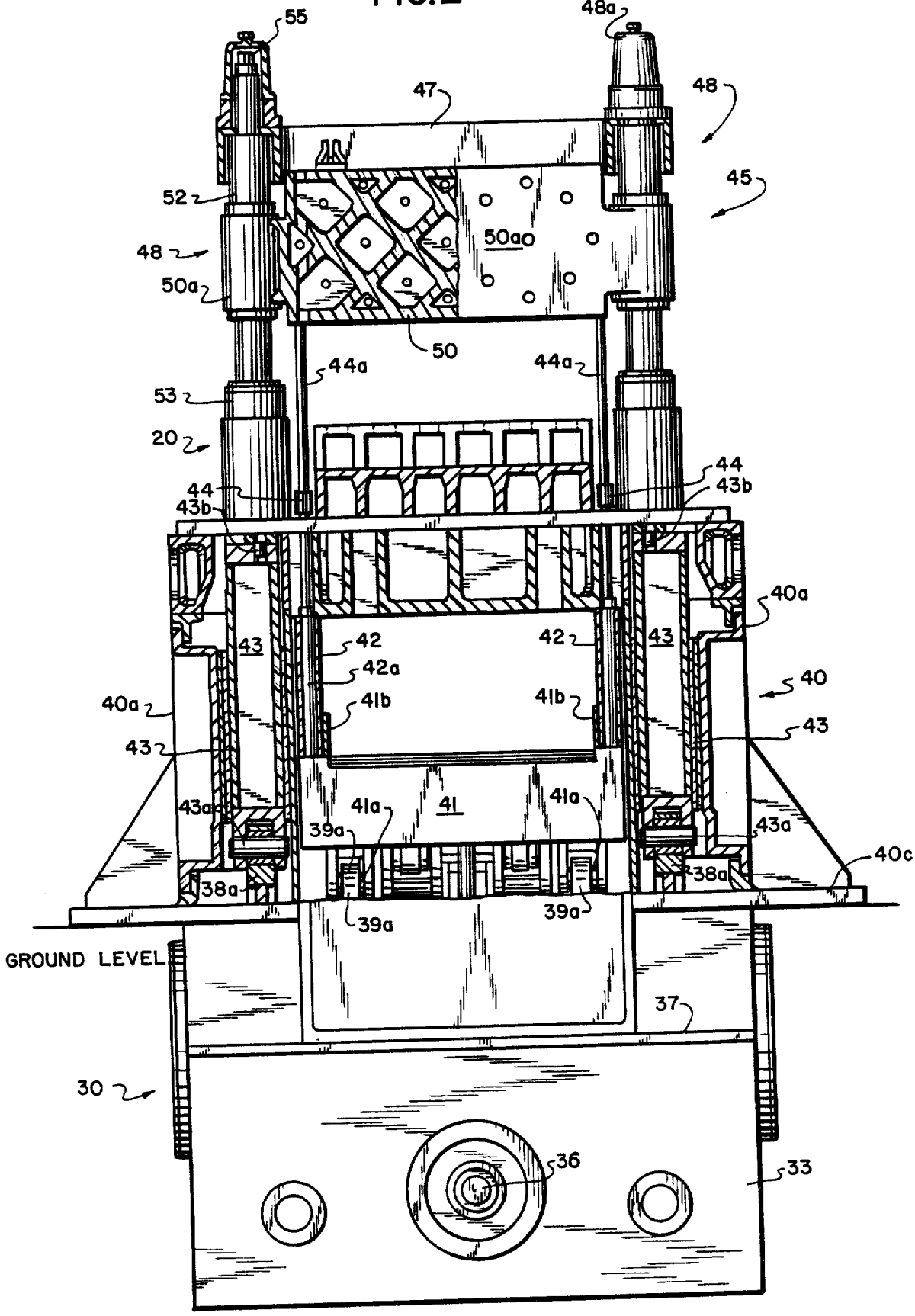
FIG. 2 is a side elevational view partially in section of the press of FIG. 1 with portions of the frame work removed and shown approximately at the center thereof from top to bottom.
Figure 3:
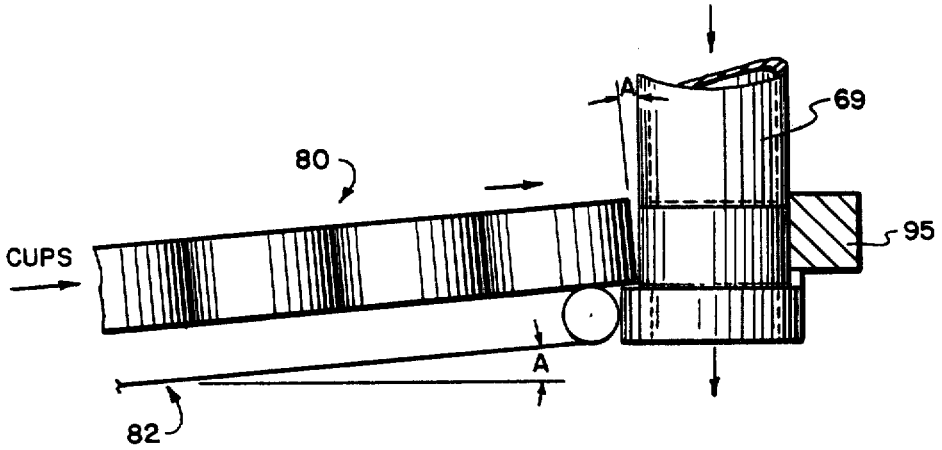
FIG. 3 is a schematic representation of the transfer jam feed technique used in connection with feeding cups into a redraw operation.
Figure 4:
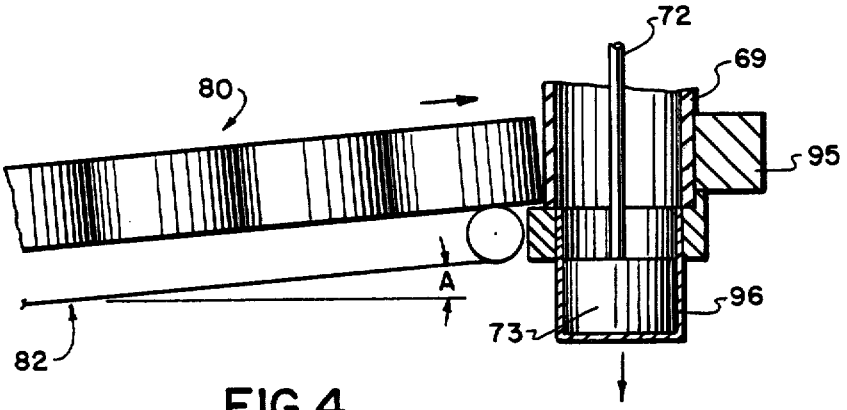
FIG. 4 is similar to FIG. 3 except that the cup is now shown redrawn.
Figure 5:
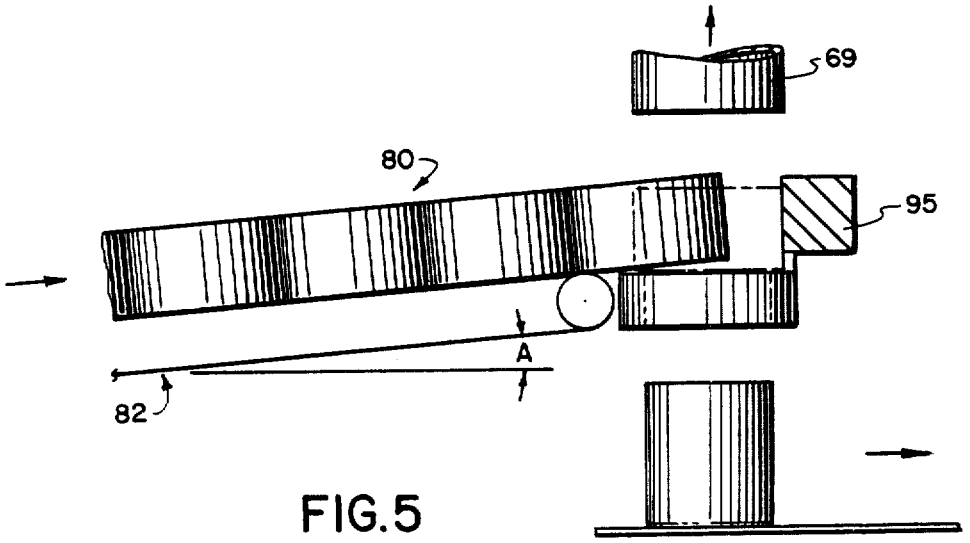
FIG. 5 is similar to FIGS. 3 and 4 but shows how the next cup is fed into alignment for redrawing and the preceding cup is removed.
Figure 7:
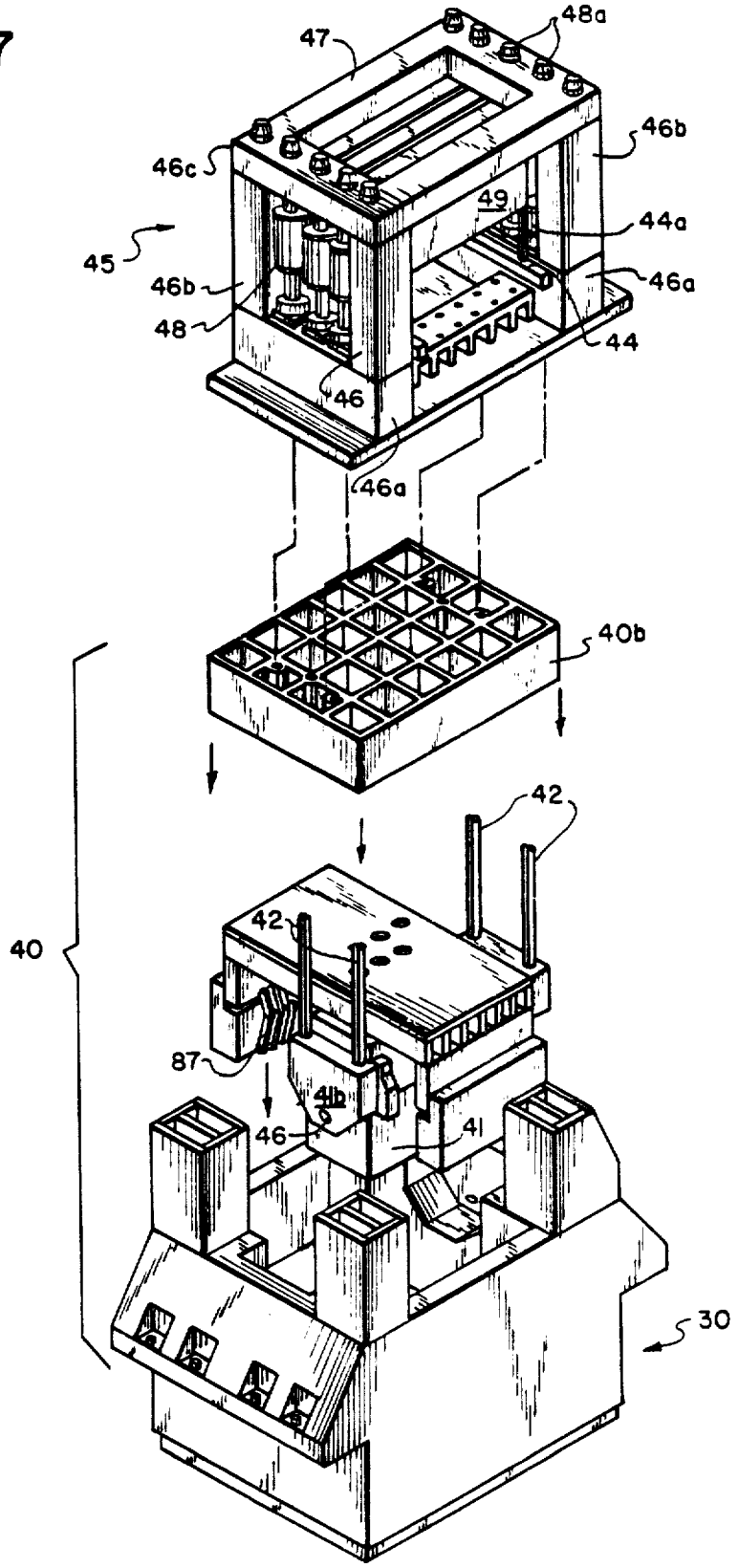
FIG. 7 shows an exploded view in perspective of the various large assemblies of the press and how they cooperate with one another. For clarity details have been omitted from FIG. 7 and as such it is largely schematic.

The middle section 40 of the press 20 FIGS. 1, 2 and 7 consists of a pair of sides 40*a* and a top 40*b* which connect together to form a hollow box-like structure which sits over the crank case 33 flanged upper face 37 and middle section 40 includes a pair of buttressed downward facing support flanges 40*c* that support the middle section 40 at what would be ground level for the press structure, see FIGS. 1 and 2. Riding within the middle section 40 is a lower press ram 41 which includes downwardly directed clevis and pin connections 41*a* that pivotally connect to the upper ends of connecting rods 39*a*, such that in the preferred embodiment the ram 41 has a 9" stroke, FIG. 9. In a conventional manner ram 41 is carried for controlled vertical movement within section 40 by flat gibbing plates and a bushed centerpost. Lubrication for the gibbing plates and centerpost are beneath the forming area of the ram 41 such that lubricant can drain directly into the crankcase 33 without interferring with the formed articles. Atop lower ram 41 are a pair of upstanding support shoulders 41*b* which are located at each end of ram 41 near the sides 40*a* of middle section 40. A pair of tie rods 42 extend upwardly from supports 41*b* for driving connection with the upper portion of the press 20 at blocks 44.

Similarly, the upper ends of connecting rods 38*a* carry conventional slide members 43 which are box shaped in cross section and are guided by gibbing within the middle section 40 for reciprocatory movement just inside sides 40*a*. Members 43 are located between the inside of sides 40*a* and the outside ends of ram 41. The lubrication for the aforesaid gibbing is apart from ram 41 and can easily drain back into the crankcase 33. The lower ends of slide members 43 contain clevis and pin connections 43*a* and the upper ends include threaded openings 43*b* for connecting to upper drive for the center or redraw ram located as will be explained in the top of the press 20. The members 43 extend upwardly through the middle section 40 of the press 20. In the preferred embodiment the stroke of members 43 is 12".

The top section 45 of the press 20 is composed of a pair of box shaped side members 46 that are open through their middle and include a base 46*a* and a pair of upstanding posts 46*b* and a top 47 see FIG. 1. Atop the box shaped side members 46 is carried top 47 which ties both side members 46 together. This construction leaves the inside of the top section open transversely at the space between the side posts 46*b*. On each side of press 20 in the central space between the side posts 46*b* are three gibbing systems 48 which independently support the upper rams 49 and 50 for clamping and redrawing respectively, see FIG. 10. Gibbing systems 48 are located at each end of their respective rams 49 and 50, FIG. 2, such that the rams 49 and 50 are carried aside one another for parallel reciprocatory movement along the gibbing systems 48. There are two (front and rear) upper rams 48 for clamping and nested between them is the upper ram 50 for drawing, FIG. 6. The tie rods 42*a* extend through spacers 42 in the press section 40 and up to the outer rams 49 which are driven by means of blocks 44 and extension rods 44*a*, FIG. 2. The center part of the gibbing systems 48 is arranged to directly drive ram 50 as same is connected to member 43 as will be explained.

Figure 10:
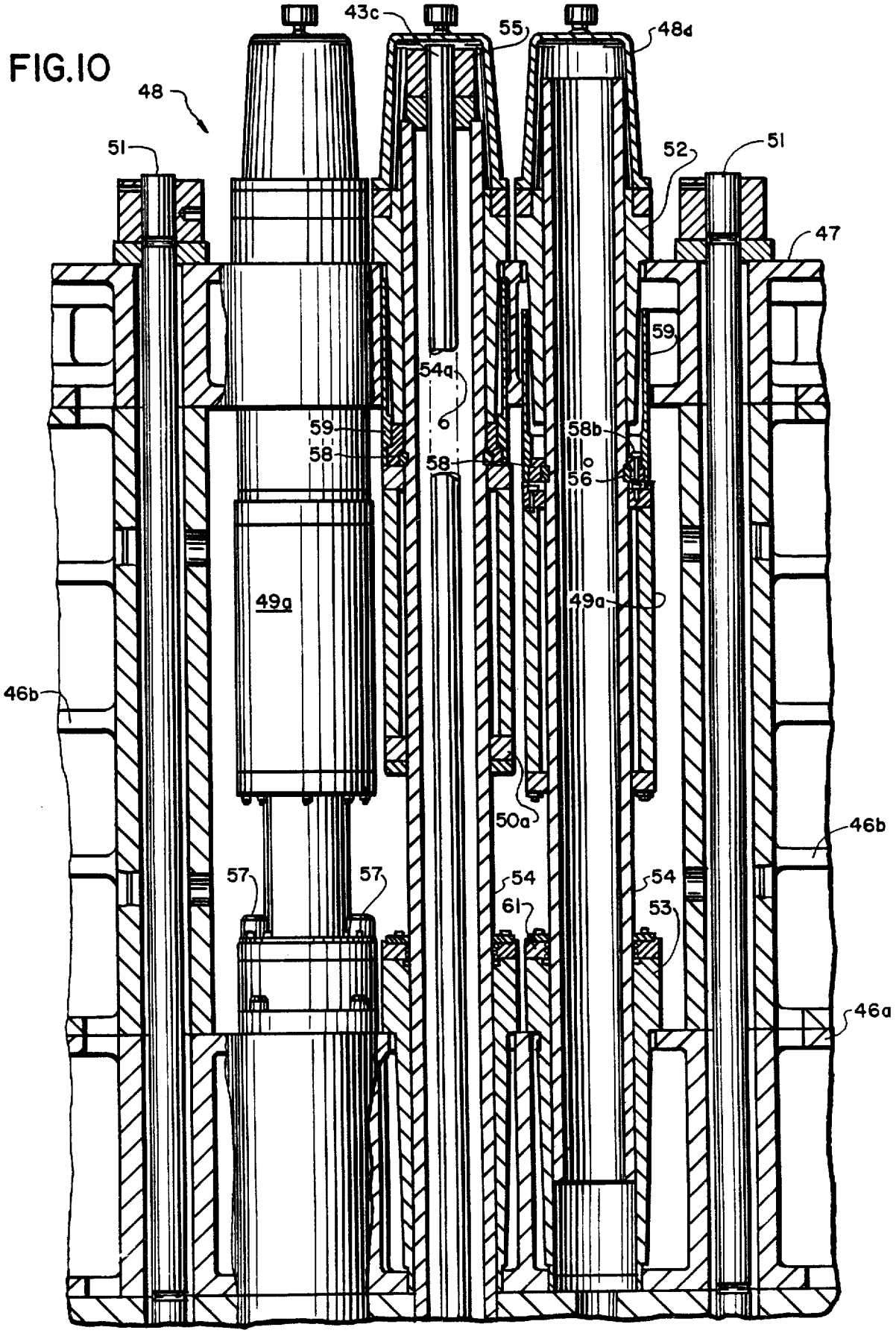
FIG. 10 is a partial sectional view of the gibbing system used to support the rams in the upper portion of the press of FIG. 1.

Turning now to FIG. 10, which is a side elevational view partially in section of the gibbing system 48, it shows how same relates with the posts 46*b*, the base 46*a* and the top 47. Holding the posts 46*b* and the top and base members 47 and 46*a* respectively are a pair of tie rods 51 which clamp the box shaped side members 46 together leaving an inside opening for receiving the three gibbing systems 48.

Each tie rod 51 is disposed at a corner of the press 20 and is positioned to extend from the top 47 through sections 45, 40 and 30 to hold the press 20 together. Each of the sections 30, 40 and 45 can be independently fashioned and tested prior to final assembly, such split construction facilitates manufacture and repair. The drive systems are similarly split at 38*a* and 39*a* between sections 30 and 40 and at 43*b* and 44 between sections 40 and 45. Tie rods 51 are conventional hollow tubular members composed of inner and outer sleeves one in tension and the other in compression such that loadings applied are easily handled without distortion of the tie rods 51. For assembly of the press 20, rods 51 are heated to expand them and then nuts are tightened and upon cooling the tie rods 51 assume a preload.

Although one side for system 48 is shown in FIG. 10, it should be understood that the opposite side is identical. The gibbing system 48 includes upper and lower bushings 52 and 53 respectively adapted to support a hollow tubular member 54 in vertical relation between the top 47 and the base 46*a*. For each side member 46 there are three sets of upper and lower bushings 52 and 53 such that three tubular members 54 are carried in parallel relation to one another and are contained within the open center of side members 46. The tubes 54 are free to move vertically relative to their respective bushings 52 and 53. An axially disposed rod 43*c* is the connection to members 43 through threaded hole 43*b* and it extends through the center tubular members 54 along the axis of each and is connected to same by means of fasteners 55 at the top of each end of the center tubular members 54. The top nut fastener 55 is used to pull ram 50 down tight against slide 43. Movement of the rams 49 is caused by members and tie rods 42*a* through blocks 44. Consequently, the rams 49 are driven by tie rods 42*a* which pass through spacers 42 connected to blocks 44 and rods 44*a* with a 9" stroke and the center gibbing system 48 located between the outer two is driven by tie rod 44 with a 12" stroke. Similarly, movement of ram 50 is caused by members 45 and the rods 43*c* which pass upwardly through the center gibs of system 48. More particularly, the rams 49 and 50 are carried at their ends 50*a* and 49*a* for controlled parallel vertical movement of the respective rams with tubular members 54. The ends 49*a* and 50*a* of the rams are keyed by keys 56 to move up and down with the tubular members 54 as the rams 49 and 50 move vertically with the controlled reciprocatory movement of their respective drive systems.

The bushings 52 and 53 are bolted or clamped to their respective supports 47 and 46*a* by means of clamping bolts 57 such that once the lower bushing 53 has been positioned in its opening in the base 46*a* the upper bushing 52 can be easily aligned axially with respect to the lower bushing and then clamped by bolts 57 into place. FIG. 10. Between the tubular member 54 and its ram there is a sealing ring 58. The sealing ring 58 is located just above the ram and is cup shaped upward toward bushing 52 so as to provide an upwardly extended apron 59 which acts to catch oil pumped up into the gibbing systems 48 between the bushings 52 and the tubular members 54. Specifically, after the oil passes through the clearance therebetween it enters the hollow center of member 54 through a hole 54*a*, provided in the side of tubular member 54, and thus may pass downwardly through the area in which member 43 is contained and back to the crankcase 33. Consequently, the upper lubrication system for the clearance between the bushing 52 and the tubular member 54 are sealed relative to the outside atmosphere. Similarly, the lower oiling system for bushings 53 includes a sealing ring 61 which is attached to the top of bushing 53 to prevent oil carried in the clearance between the bushings 53, and the tubular members 54 from leaking. Pressure lubrication is provided (but not shown) for the clearance space between the bushings 53 and the tubular members 54. This space terminates at its lower end inside bushing 53 and so it permits the lubricating oil to pass downwardly along the passages for the respective drive systems and back to the crankcase 33. An O-ring 62 about the lower bushing 53 seals same to the base 46*a* such that the lubricating oil has no means of escape.

Sealing rings 58 are also used to clamp keys 56 between ram ends 49*a* or 50*a* and their tubular member 54 as shown in FIG. 10. A series of clamping bolts 58*b* are used for this purpose. Each ram is thus able to move with the controlled vertical movement of members 54 in accordance with its lubricated gibbing system 48. The gibbing systems 48 are provided with a top sealing cap and breather 48*a* located atop the top 47.

Each of the clamp rams 49 is elongated and greater in vertical section than horizontal. Within each clamp ram 49 are a series of vertically disposed hollow cylindrical passages designed to contain the redraw tooling and more specifically the forming and clamping members which move with the ram to redraw the partially formed container. Above and transverse to the rams 49 are a pair of spaced apart beams 96 connected between the rams 49 and gas springs 60 are positioned beneath top 47 aside rams 49, FIG. 1.

Figure 11:
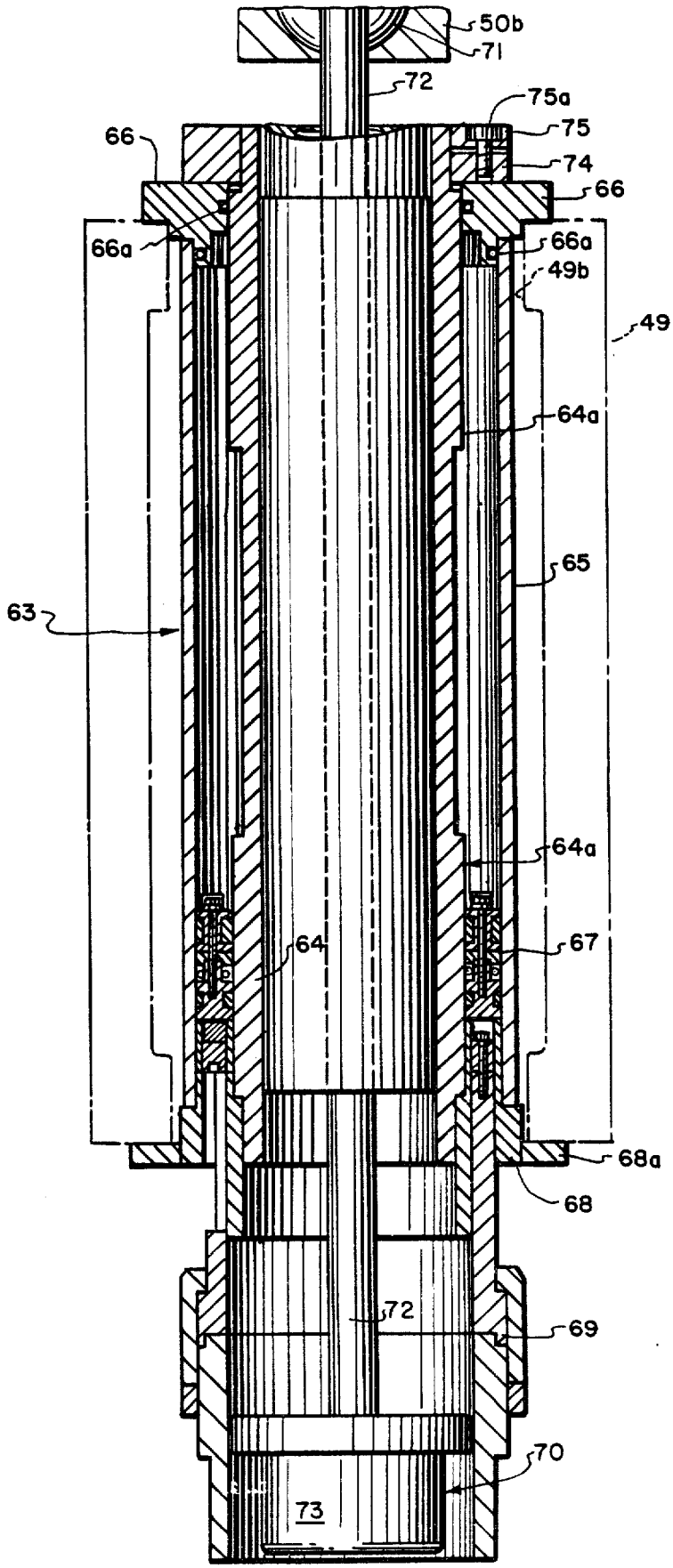
FIG. 11 is a sectional view through a ram showing the cooperation of a clamping redrawing sleeve cushion cylinder and its coaxially disposed punch.

FIG. 11 shows a partial section through the press 20 taken vertically at a point where the plane would cut through the middle of the cylindrical openings 49b in the rams 49. The opening is labeled 49b in FIG. 11 and it contains a unique cushion cylinder assembly 63 used to clamp the partially formed container during the first and second redrawing operations. More particularly, the cushion cylinder 63 includes a centrally disposed hollow inner tube 64. Inner tube 64 is symmetrical about a horizontal plane through its middle. That is to say that, it is designed so that either end of tube 64 can be used in place of the other. The reason being that upper and lower section work surfaces 64a are designed for sealing engagement and can be reversed in order to double the useful life of same since the bottom one will wear faster than the other as the bottom is the surface across which movement takes place. The cushion cylinders 63 have concentrically disposed outer tubes 65 cut from straight tubing and which tubes 65 are held in spaced apart coaxial relation to inner tubes 64 by shouldered mounting caps 66 positioned at the top end of tubes 65. O-rings 66a are used to seal the tubes 64 and 65 and are carried in grooves in the mounting caps 66. Similarly, at the bottom end of tubes 64 and 65 there are Slydring TM assembly 67 (W. S. Shamban & Company) disposed within the hollow concentric space between the inside of outer tubes 65 and the lower outside work surfaces 64a of the inner tubes 64. tube 65 and seal 66a form a first sealing mean that moves with the ram and tube 64 and seal 67 are a second sealing means responsive to the redraw sleeve. Bottom caps 68 and their locator rings 68a mount the bottoms of the outer tubes 65 to the rams 49 whereas the mounting caps 66 connect the upper ends of tubes 65 to the upper end of the ram cylindrical openings 49b. Similarly, rings 68a and caps 68 hold tubes 64 and 65 in spaced concentric relation. The inner cylinder 64 is held in place vertically by the mechanical connections at each end. The gas pressure (nitrogen) resides in the annular space between the tubes 64 and 65.

The Slydring TM seals attach to the locking redraw sleeve assemblies 69 such that nitrogen captured in the space between tubes 64 and 65 is compressed as Slydring TM seals 67 moves upwardly during clamping loading, relative to the downward movement of rams 49 which carry the tubes 64 and 65 downwardly. The connection between redraw sleeve assembly 69 and Slydring TM seal 67 is through engagement of mating surfaces which do not appear in the sectional view shown. The ultimate downward travel of redraw sleeve assembly 69 is thus controlled. Gas escape passages (not shown) are connected between the space for the nitrogen gas and a gas reservoir, thus in a manner well known the amount of clamping of the redraw sleeve assemblies 69 against the partially formed containers can be controlled.

Through the hollow centers of the redraw sleeves 69 pass the punch assemblies 70. Each assembly 70 is carried by a cantilever support hanger 50b extending from ram 50 toward ram 49 such that the punch assembly 70 will have the 12" stroke of ram 50, FIG. 6. Cantilever hanger 50b includes a pair of spherical support bushings 71 which are vertically spaced apart thereon and which act to align the punch drive rod 72 with the axis of the cushion cylinder assembly 63 as the former passes downwardly through the center of the latter to connect with and carry the first redraw punch 73 for each punch assembly 70, FIG. 11. A bushing 74 and its retaining cap 75 are mounted above mounting cap 66 to secure same by cap screw 75a as well as bushing 74 to the ram 49. The punch drive rod 72 is thus additionally axially aligned for reciprocatory movement relative to the cushion assembly 63 by bushing 74.

Figure 6:
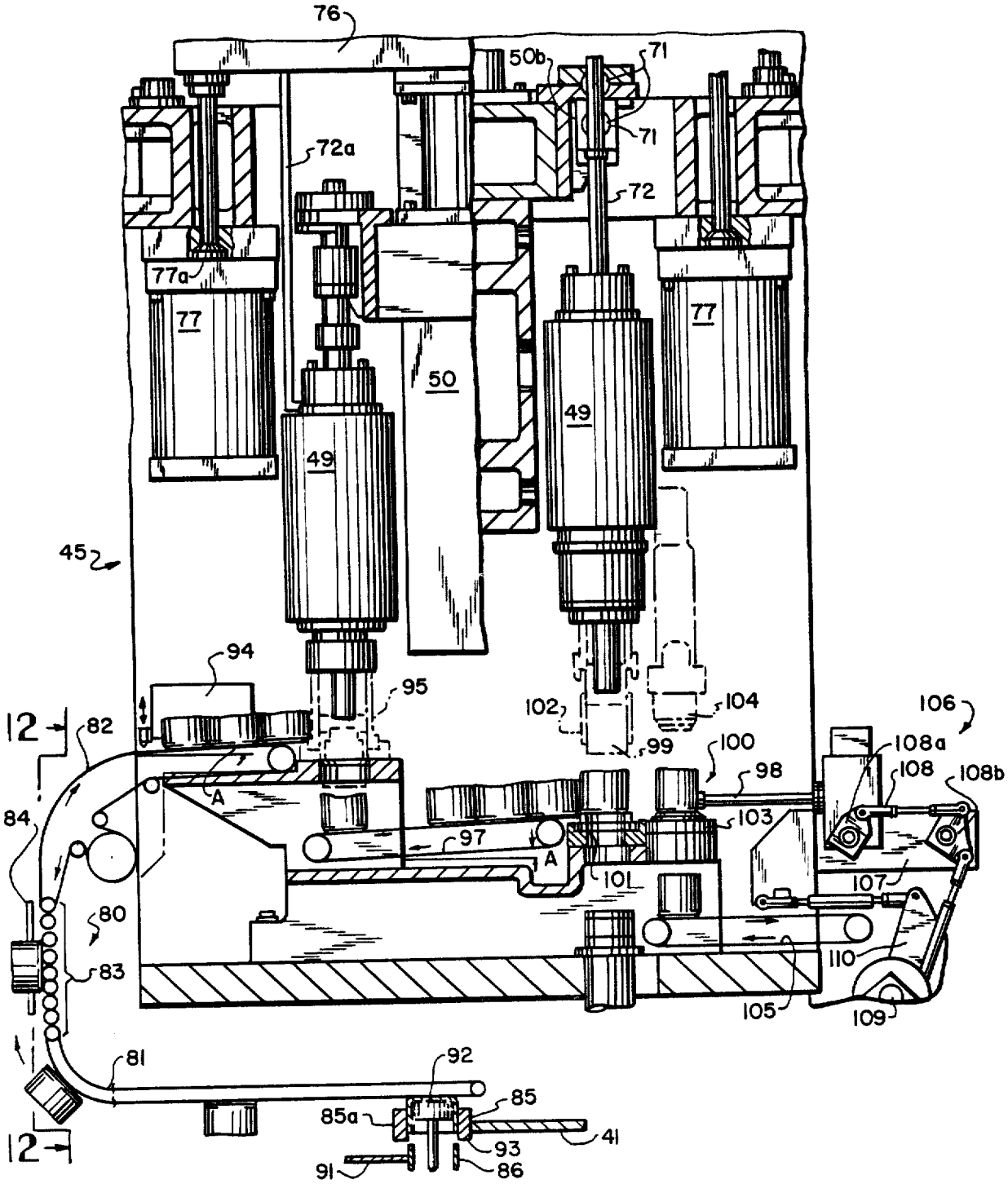
FIG. 6 is a side elevational view of a portion of the press as it would appear if a side of the press was removed in order to allow examination of the forming of a container by the steps from sheet blanking to flange trimming;.

In the preferred arrangement, the punch 73 moves with the 12" stroke of ram 50 while the redraw sleeve 69 has the 9" stroke of the ram 49. On both sides of ram 50 toward the front and the rear of the press 20 extend cantilever hangers 50b, and they carry the punch drive rods 72 for the first and second redraw profile tooling for each lane in a manner identical to that used and already explained for the porch 73 of the first redraw station. More specifically, the partially formed containers are moved through the press transverse to the direction of elongation of the rams 49 and 50. When the front ram 49 comes down it carries with its cushion cylinder assemblies 63 (sufficient in number for up to six lanes of tooling and front and rear clamping rams 49). Similarly, ram 50 carries with it in cantilever fashion off 50b up to six punch assemblies 70 on each side and each assembly 70 coaxially passes through the hollow center of a cushion cylinder assembly 63. The partially formed cups or containers from the lower cupping section 40 are thus first redrawn into a taller container with a smaller diameter as such punch 73 pushes the cup through its respective draw die, FIGS. 3, 4, 5 and 6. The container then moves transversely under ram 50 to the second redraw-profile station where the rear or other ram 49 carries its cushion cylinder assemblies 63 which coaxially support the other second redraw punches in alignment to the redraw the partially formed containers to a still taller height and smaller diameter containers. FIG. 1 also shows the back of the press 20 where the second redrawing takes place. FIG. 6 is split along its center line such that ram 50 is shown on one side thereof at the bottom of its 12" stroke and on the other side at the top of its stroke.

A horizontally disposed support beam 76 located above the press 20 supports the weight of the rams through connectors 72a. In a manner similar to that with rams 49 and gas springs 60 beam 76 from the connectors 72a extend outwardly to front and rear gas springs 77. Each spring 77 has a drive rod 77a which connects to the support beam 76. Thus, the return stroke of the first redraw punch 73 as caused by the ram 50 is counterbalanced by the gas springs 77.

Figure 12:
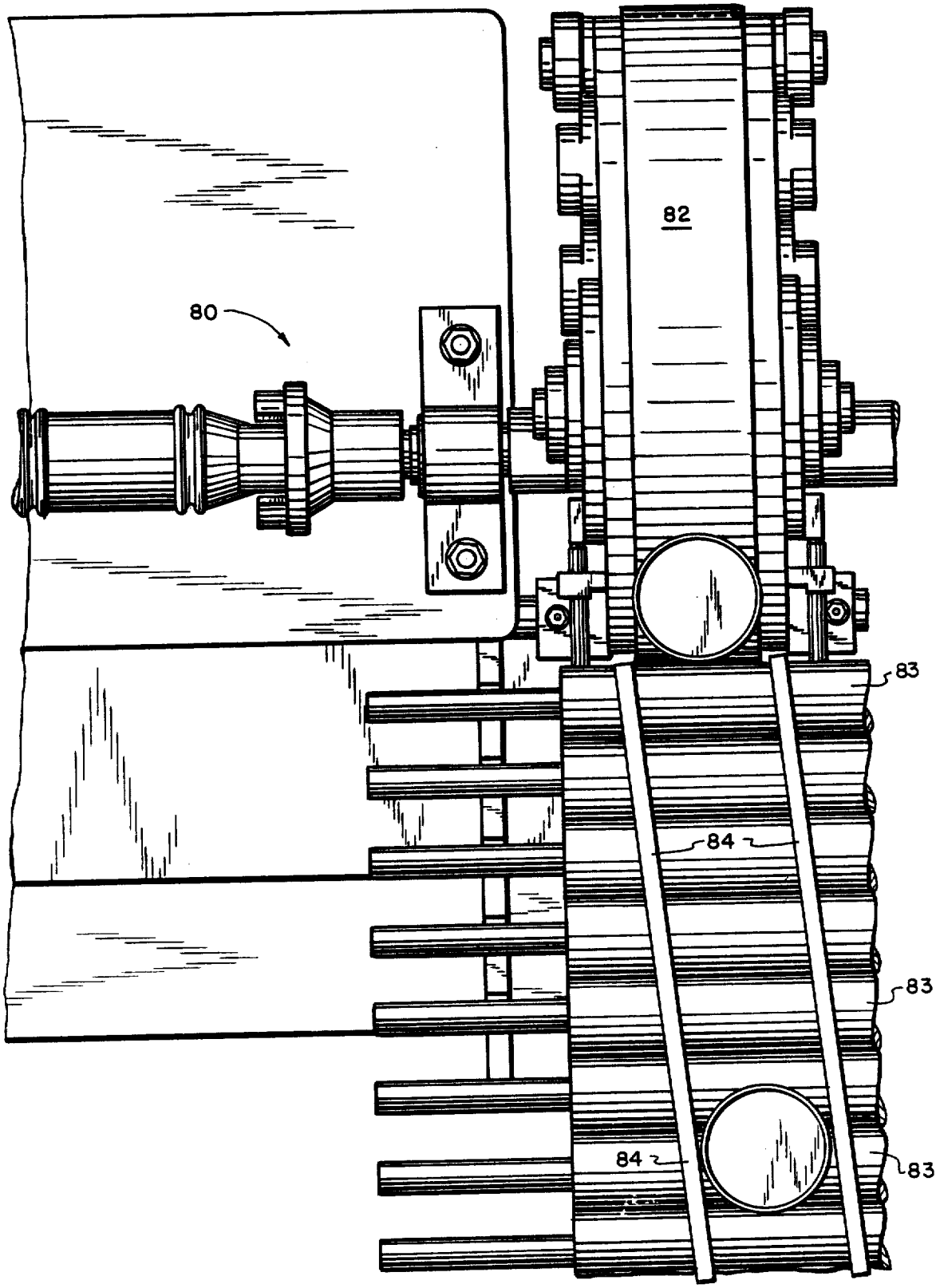
FIG. 12 is a partial front elevational view showing the transfer rollers and the upper belt used in moving cups into the redraw section of the press.

As mentioned, the containers are transferred through the top section 45 of the press 20 from front to rear and through the middle section 40 from rear to front. This process is best shown in FIGS. 3, 4, 5, 6 and 12 wherein a transfer system 80 from the top middle section 40 of the press 20 and to the top section 45 of the press 20 is shown. The transfer system 80 includes a lower magnetic drive belt 81 and an upper magnetic belt 82. Between the belts 81 and 82 are eight horizontally disposed magnetic rollers 83 mounted in juxtaposed relation for rotating in the same direction (clockwise) such that the containers are passed from roller to roller. The metallic cups shown in FIGS. 3, 4, 5, 6 and 12 are magnetically held by their bottoms by the magnetized rollers 83 or the magnetized belts 81 or 82. It should be appreciated that the side to side spacing between the lower belts 81 and the upper belts 82 may be different such that aligning the containers to follow a path which will take it from the lower belt 81 to its respective upper belt 82 requires lateral motion. That is to say that, at least some lanes of cups must be shifted laterally. This is done by guide bars 84 associated with the rollers 83. Each lane has its respective set of guide bars 84 which cooperate to assure that the containers are properly aligned with and received by the appropriate upper magnetic belt 82, only one lane is shown in FIGS. 6 and 12.

Turning now to FIG. 6, which is a side elevational view of the can transfer system 80 taken through the center of the press 20 and along a plane defined by line 6—6 shown in FIG. 1. The entire operation of moving the containers from the middle section 40 to the top section 45 will be apparent as well as the various operations which take place in the press 20 for one lane as a result of the tooling carried by both the front and rear upper rams 49, and the ram 50. Starting at the lower left hand corner of FIG. 6, the sheet of scrolled strip is intermittently brought into the press at a sheet feed line so designated and is moved from left to right. The sheet is first blanked in a conventional well known manner between die shear ring 85 and a punch shear ring 86. The die shear ring 85 is moved by the ram 41 through a series of toggling knuckles, FIG. 8, which are cam driven by side face cams 41*c* associated with the flanks of ram 41. The knuckle arrangement is generally designated 87 (see FIG. 8) and is toggle like in its action. More specifically, there is on each side of the ram 41 a lower toggle link 88 and an upper toggle link 89. Each lower toggle link 88 is pinned to pivot relative to the inside of side wall 40*a* and extends upwardly to a pivot connection with an upper toggle link 89. At the pivot connection between the links 88 and 89 there is carried a roller follower 90 which ride across the face of cam 41*c*. Upper toggle links 89 are pivotally attached to a support 91 which moves the punch shear ring 84. Consequently, the stroke of the blanking ring for shearing the stock to its cut edge is minimized. The support 91 also clamps the blank during the cupping operation. The lower toggle links 88 are jack screw 91*a* connected to sides 40*a* and by unscrewing the connection of links 88, the roller followers 90 may be moved off the cam face 41*c* beyond their normal stroke. Thus, the knuckle system 87 can be folded or collapsed such that maintenance clearance in this portion of the tooling is quickly provided.

The hollow center 85*a* of the die shear ring 85 includes a cupping punch 92 which is connected to ram 41 and moves a full 9" during its stroke. The locking of the blank after shearing and during cupping is provided as explained by clamping between the die shear ring 85 and a tool face 93 by the action of the knuckle system 87. The punch 92 thus draws the cup upwardly forming the blank into a hollow thin walled cylindrical cup with an integral bottom and no flange as same is brought to rest against the lower magnetic drive belt 81, see FIG. 6.

Belt 81 moves from right to left carrying the cup in the general direction that the sheet moves as same came into the blanking and cupping tools. Just outside the press 20 magnetic conveyor belt 81 curves upwardly toward rollers 83 and the cup is carried to the first of the rollers 83 where it is moved as explained between the guide bars 84 until it is brought into alignment with the leading edge of magnetic drive belt 82. As seen in FIGS. 6 and 12, the conveyor belts move in a clockwise direction. The magnetic belt 82 carries the cup upwardly before curving into the top section 45 of the press 20. As can be appreciated from FIGS. 6 and 12, the cup is made so that it is open downwardly and as the transfer system 80 moves the cup it rotates it through an arc or 180° such that it is now open upwardly. The magnetic drive belt 82 extends into the top section of the press at a slightly upward incline or angle "A" as shown in FIGS. 3, 4, 5 and 6. The cups are held as they move into the press by an escapement mechanism 94 which is provided to assure that there are sufficient number of cups being carried by the belt 82 to provide the requisite jam feeding of the cups into the first redraw station of the press. More particularly, a cup holder 95 shown in FIG. 6 is provided to catch the cups on conveyor belt 82. Holder 95 operates only after escapement 94 captured a sufficient number of cups to assure that adequate force will be available to push the furthest cup into and against cup holder 95. Since belt 82 is angled upwardly, the lower side wall of the last cup on the belt 82 bears against the lower side wall of the cup in holder 95. That is to say that, the cup in holder 95 has its axis in alignment with the axis of the punch 73 and the next adjacent or jamming cup has its axis normal to the surface of the drive belt 82. The upper edges or mouths of these two containers are spaced apart because their side walls are at the angle of belt inclination "A", thus, leaving room for the tooling to move during forming.

Once again, in FIGS. 3, 4, 5 and 6, the container is pushed through the first redraw die 96 thus making the container taller but smaller in diameter. At the bottom of the first redraw stroke the container is stripped from the punch 73 and lands on intermediate magnetic transfer belt 97. Belt 97 is angled upwardly at an angle "A" for the same purpose as was the terminal portion of belt 82. Belt 97 rotates clockwise carrying the redrawn containers further into the press 20 to the second redraw-profile station. Thus, the intermediate magnetic transfer belt 97 carries the first draw containers under ram 50 and into alignment with the second redraw station carried in rear ram 49. The cup holder for the second redraw-profile station is associated with the station and includes curved abutments on each side adapted not only to align the container with the axis of the second redraw punch 99 but also slotted to permit the redrawn and profiled container to be moved by a vacuum finger 98 to a trimming station 100. That is to say, that after the second redraw operation the container is of a smaller diameter and so it is able to be moved by finger 98 through the slot toward the station 100.

The redraw punch pushes the container almost entirely through a draw die 101 in the second redraw operation thus, a flange is left on the redrawn container. Near the bottom of the stroke a bottom profiling tool is held upwardly against the bottom of the container by the action of its gas spring mounting in the press such that a bottom or domed profile is established in the container as the container reaches the bottom of its stroke. This doming operation causes the container to take substantially all of its final configuration. As the punch 99 and its draw sleeve 102 retract upwardly the redrawn and bottom profiled container is carried up through the draw die 101 until it has cleared the die 101 at which point it is in alignment with vacuum finger 98. Finger 98 grasps the side of the container to pull same from left to right while maintaining its vertical alignment. This movement by finger 98 shifts the container to the trimming station 100 such that the container is in alignment for flange trimming. More particularly, a die 103 is provided which is larger than the container diameter but equal to the flange diameter. Die 103 is set to trim the flange to the required dimension for a hermetic double seam flange. A punch assembly 104 pushes the untrimmed container downwardly through the die 103 and causes the trimmed container to drop on to a magnetic belt conveyor 105 below the die 103 such that the container can be easily removed from the press 20. The punch assembly 104 is attached to the rear side of ram 49 such that it moves therewith. Consequently, and when containers are available each stroke of rear ram 49 redraws and profiles one container while simultaneously trimming the preceding container.

In FIG. 6 a mechanism 106 is shown for moving the vacuum finger 98. This mechanism 106 is designed to shuttle the vacuum finger 98 between its container holding position aligning the container with the second redraw-profile station and the axis of the trim station 100. The motion of the vacuum finger cannot be purely reciprocatory since it has to move upwardly in order to clear the trim ring left atop the trim die 103 as the vacuum finger 98 moves towards its position as a container holder for the second redraw-profile station. Similarly, the vacuum fingers 98 must be timed to move out of the way of the flange of the cup as same is lowered while being redrawn before profiling and out of the way of assembly 104 as same moves to trim. Mechanism 106 includes a first portion 107 which is designed to reciprocate the vacuum finger and a second portion 108 which is designed to lift the vacuum finger relative to the trim die 103. The first and second portions rotate relative to a drive axis 109 but are driven independently of one another. The first portion 107 has motion that is converted from rotary to reciprocatory by eccentrically mounted rotating link 110. The second portion 108 is cammed by means of eccentric links **108*a*** in a manner quite independent of the first portion but only insofar as their respective drive systems are concerned.

Figure 8:
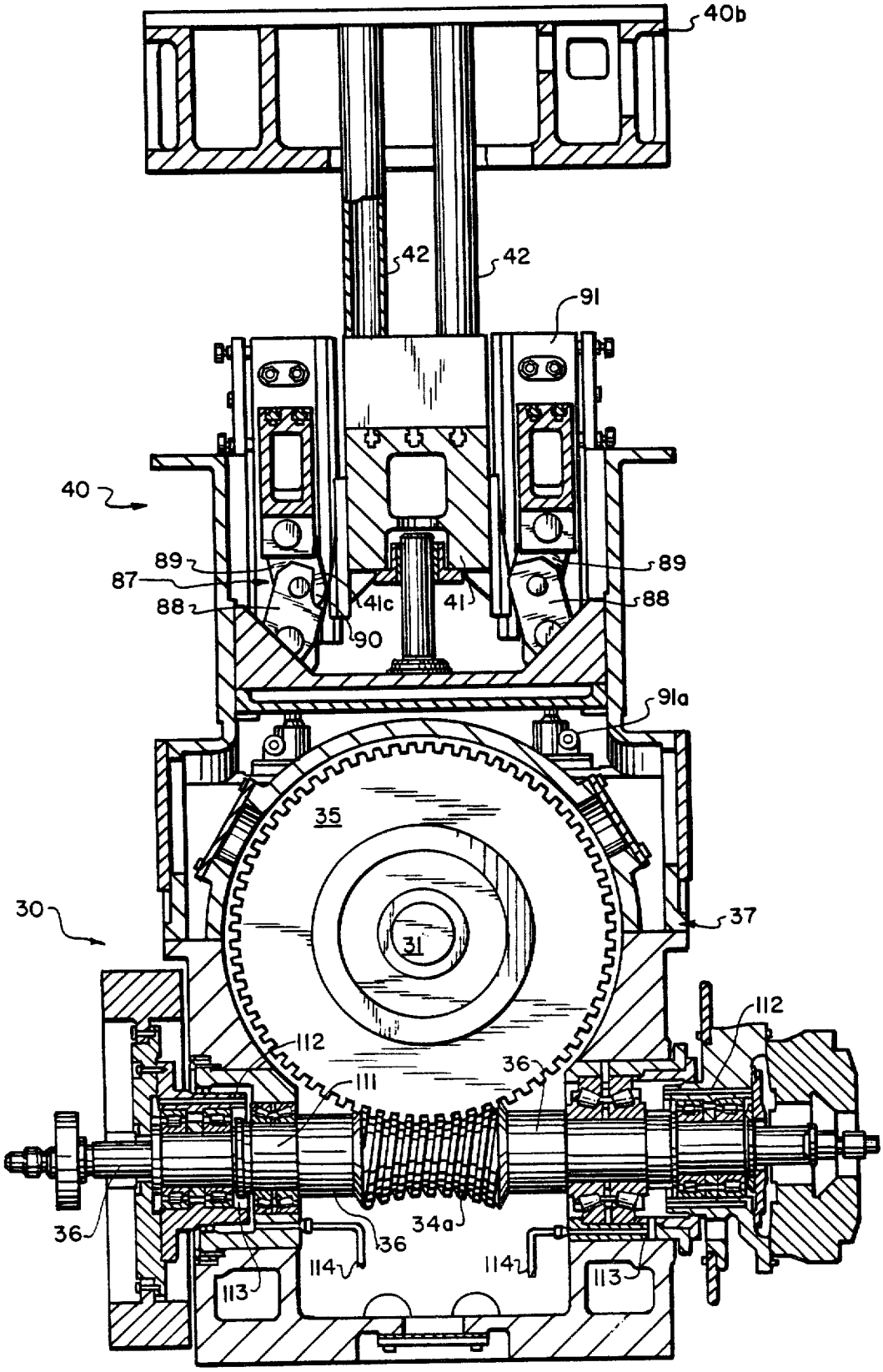
FIG. 8 is a side cross sectional view of the lower portion of the press that being the sections primarily below and above ground level with particular emphasis on the worm drive and lower ram support and operation.

In FIG. 8, the worm **34*a* is shown supported by a pair of roller bearings 111. These bearings are carried in the walls of the crankcase 33 and support the shaft 35 which carries the worm 34*a*. Oil is supplied to bearings 111 by means of upper oil passage 112 from the main pump for the press in a manner well known. The main pump is not shown in the figures. The main pump supplies a sufficient head of oil to all of the operative components of the press. In order to balance the flow, restrictions are placed in the various feed manifolding passages to assure that adequate control of flow is provided to the various areas within the press. More specifically, passages 112 carry oil through the upper crankcase 33 walls into the bearings 111. For purposes of evacuating the bearings and controlling the amount of oil passing therethrough, there are a pair of lower passages 113 which are provided to drain the bearings 111. These passages 113 are connected by means of internal tubing 114** to a suction pump, not shown.

In the preferred embodiment a Model L75 MEGATOR pump (not shown) capable of moving 6.5 gallons per minute at 45 psi is used. This pump is a sliding-shoe type which includes eccentric discs fit closely in displacement chambers within the shoes such that eccentric movement of the discs generates horizontal movement of the discs and verticle movement of the shoes. The horizontal motion provides the displacement of fluid in the chamber; the verticle motion shuttles the shoe controlling the entry and discharge of the pump fluid. In this case synthetic gear oil is used to cool and lubricate the bearings 111, FIG. 8. Once the pump begins to operate a hydraulic pressure difference is generated; that difference holds the shoe in contact with the ports which control the suction and delivery of the pump. The Megator pump can be operated without priming in that it will repeatedly self prime and the Megator model L75 has a slightly higher volumetric capacity than the volume necessary to lubricate and cool the roller bearings 111. The pump can be used to pump high viscosity fluids, run dry, pump air and yet will maintain a high suction capacity. Volumetric control of oil entering and leaving the highly loaded worm gear roller bearings 111 is controlled and flow of cooling lubricant can be maintained.

Various features have been shown and described in connection with a large multilane, multioperation, multilevel inverted press. Those skilled in the arts will no doubt appreciate that refinements to materials, components, placement of components, operative sequence, methods of operation and methods of design and construction will be possible without departing from the scope of the claims which follow.

What is claimed is:

1. A pressure cylinder for providing controlled clamping force in a press for producing formed metal containers comprising:

a ram carried in the press for controlled reciprocal movement in a plane to produce clamping of a thin metal work piece during forming, a first sealing means mounted to said ram and having an opening therethrough and being carried along a line in said plane by said ram for movement in concert therewith, a second sealing means substantially contained within said first sealing means for movement therewith along said line and in said plane but independently reciprocal relative thereto while being responsive to pressure within a gas containing space defined by said first and second sealing means, a redraw sleeve carried on said second sealing means and extending from said ram such that motion of said second sealing means relative to said first sealing means results in changes in gas pressure in said space such that said redraw sleeve is applied against the work piece in accordance with said independent movement of said second sealing means, and an open passage through said first and second sealing for permitting the connection of a drive for forming tooling to pass through said passage and to operate relative to said redraw sleeve.

2. A pressure cylinder for providing controlled clamping force in a press for producing formed metal containers comprising:

a ram carried in the press for controlled reciprocal movement in a plane to produce clamping of a thin metal work piece during forming, a hollow outer tube open at each end and mounted rigidly to said ram of the forming press, the axis of said tube being carried in parallel relation to the direction of motion of said ram;

a hollow inner tube open at each end and mounted coaxially within said outer tube in spaced relation thereto to provide a space therebetween;

a first sealing means placed within and at one end of said space between said outer tube and said inner tube, a second sealing means carried for sliding within said space and at the end of said space opposite the position of said first sealing means;

a locking means carried by said inner and outer tubes to limit travel of said second sealing means with respect to said inner cylinder, a supply of pressurized in communication with said space for providing a minimum level of pressure therein, and a clamping tool carried by said second sealing means to respond to changes in pressure within said space resulting from clamping load imposed by movement of said ram during clamping.

3. The pressure cylinder of claim 2 wherein said clamping tool is attached to said second sealing means.

4. The pressure cylinder of claim 3 wherein said hollow tubes are right circular cylinders and said space is annular.

5. The pressure cylinder of claim 4 wherein said first sealing means is used to concentrically position said inner tube within said outer tube.

6. The pressure cylinder of clain 5 wherein said second sealing means is in the form of an annular piston fit within said space.

7. The pressure cylinder of claim 6 wherein said annular piston is attached to said clamping tool and the movement of same pressurizes said atmosphere.

8. The pressure cylinder of claim 7 wherein a forming tooling is supported to be reciprocally driven by means of a member passing through the hollow center of said inner tube.

9. The pressure cylinder of claim 8 wherein said ram reciprocally moves said tubes with a preset stroke and said forming tooling moves with a greater stroke.

10. The pressure cylinder of claim 9 wherein a plurality of said cylinders and associated tooling are carried on said ram.

11. The pressure cylinder of claim 10 wherein a plurality of said rams are carried in said press.

* * * * *